United States Patent [19]

Green

[11] Patent Number: 5,025,537

[45] Date of Patent: Jun. 25, 1991

[54] PROCESS FOR MAKING PRESHRUNK SIZE-FREE DENIM

[75] Inventor: James R. Green, Hockessin, Del.

[73] Assignee: E. I. Du Pont de Nemours and Company, Wilmington, Del.

[21] Appl. No.: 534,157

[22] Filed: May 24, 1990

[51] Int. Cl.[5] ..... D06B 19/00; D06M 11/05; D03D 15/00

[52] U.S. Cl. ..... 26/18.5; 8/151; 156/155; 428/224; 428/259; 26/18.6

[58] Field of Search ..... 26/18.5, 18.6; 428/224, 428/259; 156/155; 264/184; 8/149.1, 151

[56] References Cited

U.S. PATENT DOCUMENTS

| | | | |
|---|---|---|---|
| 2,251,127 | 7/1941 | Gessner | 26/18.5 |
| 3,730,679 | 5/1973 | Schuierer | 26/18.5 X |
| 3,767,756 | 10/1973 | Blades | 264/184 |
| 3,943,613 | 3/1976 | Schraud et al. | 26/18.5 X |
| 4,025,304 | 5/1977 | Fleissner | 8/151 |
| 4,121,311 | 10/1978 | Meyer | 8/151 X |
| 4,247,294 | 1/1981 | Fleissner | 8/151 X |
| 4,677,717 | 7/1987 | Magin | 26/18.5 |
| 4,863,775 | 9/1989 | Jacobs et al. | 428/91 |
| 4,918,795 | 4/1990 | Dischler | 26/18.5 X |

*Primary Examiner*—Werner H. Schroeder
*Assistant Examiner*—John J. Calvert

[57] ABSTRACT

Denim fabric having warp yarns containing cotton and high shrinkage synthetic staple fiber is desized, preshrunk and compressively shrunk.

5 Claims, 1 Drawing Sheet

PROCESS FOR MAKING PRESHRUNK SIZE-FREE DENIM

BRIEF DESCRIPTION OF THE INVENTION

This invention relates to denim fabric suitable for manufacturing garments which have the appearance of new, unwashed garments but the feel of washed and tumble-dried garments.

BACKGROUND OF THE INVENTION

In the past, commercially available denim garments have been of two basic types, one stiff but offering the look of a new garment and the other soft and giving the appearance of a used garment. In one type the denim fabric was treated with a starch finish on top of the size used for weaving the fabric, after which the fabric was shrunk to produce less than 3% shrinkage in both warp and fill directions. The finished denim was cut and sewn into garments which were sold in this condition. Alternatively, the garments were washed prior to sale to soften. Both of these garments are described as preshrunk, which indicates they are stable against laundry shrinkage. The unwashed garment offers the uniform look of a new garment but is stiff. The washed garment is soft but has the appearance of being used.

Attempts to process denim through conventional shrinkage stabilization processes, such as Sanforization ® (compressive shrinkage) without use of any size have failed since, in practice, fabric is backwound off a roll before it is cut and sewn. Tension on the fabric during backwinding elongates the fabric and causes excessive shrinkage. Partial removal of the weave size and starch (leaving 1.5%–3.5% non-fibrous material) gives some improvement but the garments are still stiff compared with washed garments.

SUMMARY OF THE INVENTION

This invention provides a method for preparing denim fabric suitable for production of garments having the uniform appearance of new garments and the soft feel of worn garments, comprising a) constructing a greige denim twill fabric with the warp yarn consisting essentially of from 20 to 90% cotton, from 10 to 80% of highly shrinkable synthetic staple fiber and optionally up to 70% of other staple fiber having low shrinkage and fill yarn consisting essentially of 20 to 100% cotton and from 0 to 80% of synthetic staple fiber, said warp yarn having been sized, b) wetting the fabric with a warm aqueous solution of an enzyme to assist in size digestion, c) imparting a warp shrinkage of less than 12% by:

1. maintaining the wet fabric, open width, in a relaxed condition at a temperature of from 50° C. to 100° C. for at least 0.5 minute,
2. rinsing the fabric in water to remove size, and
3. drying the fabric, open width, at sufficient tension to remove creases, and d) compressively shrinking the fabric up to 12% in the warp direction.

DETAILED DESCRIPTION OF THE INVENTION

Figure 1:
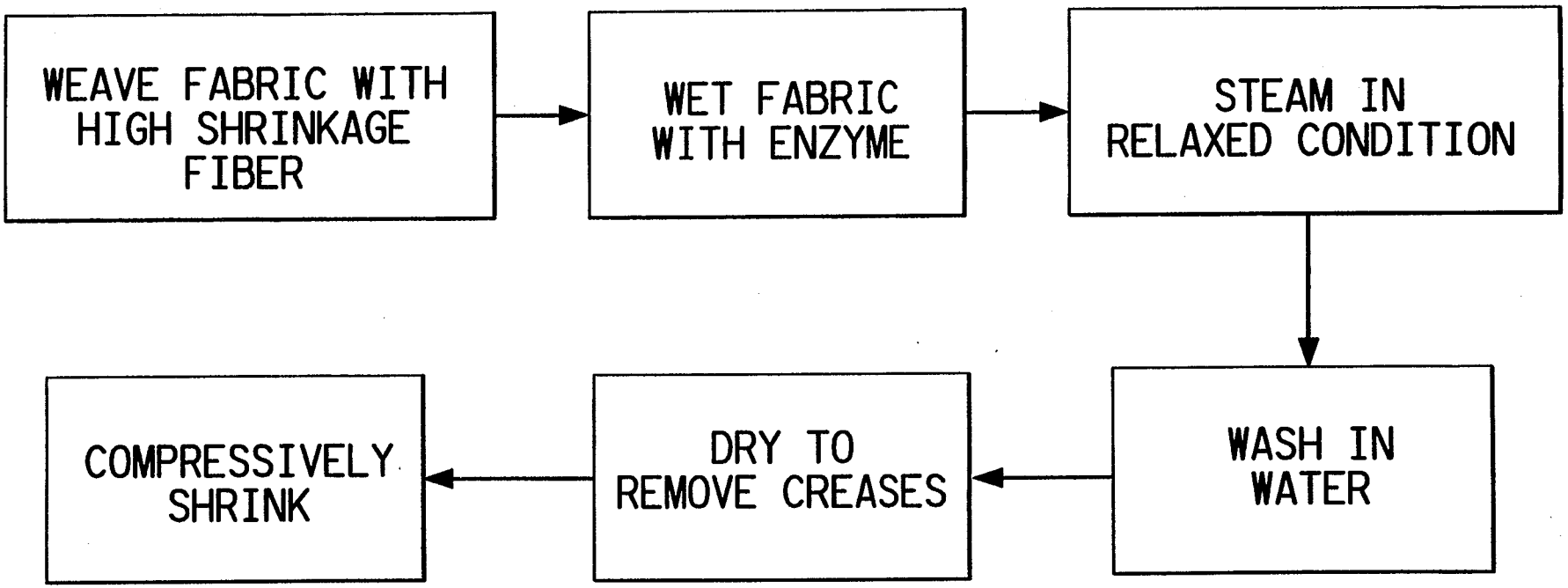
FIG. 1 is a flow diagram of the method.

Denim fabric (twill fabric) is prepared from a warp yarn which is dyed, containing 20 to 90% cotton, 10 to 80% highly shrinkable fiber and optionally up to 70% other fibers of low shrinkage and an undyed fill yarn of 20%–100% cotton and 0%–80% synthetic fiber all on a weight basis. The fabric may be singed to remove fuzz by techniques well-known in the art.

Yarns employed in weaving the twill fabric are sized to assist in weaving. A conventional size comprises starch and polyvinyl alcohol. To loosen the size or non-fibrous material, the fabric is wetted with a warm aqueous solution, often containing an enzyme to assist in size digestion and removal. The wetting is conveniently done, open width, in a wash box. The wet fabric is then placed, open width, on a horizontal surface and maintained in a relaxed condition for a period, of at least 0.5 minute, generally not more than 5 minutes at a temperature in the range of 50° C. to 100° C. to induce warp and fill shrinkage. The fabric is rinsed in warm water by passage through 1–10 wash boxes at speeds of 30 to 200 meter/minute. It is then dried, open width, over cans (rolls) under sufficient tension to remove creases. This procedure results in a fabric with less than 12% warp shrinkage, less than 4% fill shrinkage and less than 0.5% non-fibrous material such as size and starch. The exact level of shrinkage obtained is influenced by the content of high shrinkage fiber, and the duration and temperature of the wet relaxation step. The fabric is then finished by compressively shrinking (commonly Sanforizing ®) up to 12% in the warp direction to produce a soft fabric with less than 3% shrinkage in the warp and fill.

The term "highly shrinkable fiber" as used herein means staple synthetic fibers having a shrinkage of at least 5% after exposure to boiling water for 30 minutes and drying. By "low shrinkage" fiber is meant are those with a shrinkage of less than 5%. By this procedure, cotton fiber, as distinguished from yarn, has essentially no shrinkage.

It is important that the fabric contain a highly shrinkable fiber in the warp. The high shrinkage fiber pulls the warp in during relaxation and allows the fabric to attain a warp shrinkage of less than 12% through the relaxed wash process and permits one to obtain a shrinkage of less than 3% after compressive shrinkage. Backwinding the fabric off the rolls for garment manufacture inherently stretches the fabric. The presence of the high shrinkage synthetic fiber reduces the stretch.

As shown in Example 1, it is possible by this process to have negative laundry shrinkage in the warp and fill, i.e., the fabric grows a little after it is washed insuring that the fit of the garment will not be too tight. As is also shown in Example 1, low shrinkage, high strength, high modulus fiber such as poly(p-phenylene terephthalamide) (PPD-T) staple fiber, can be incorporated to further improve dimensional stability and fabric strength and durability. This fiber can be prepared as described in U.S. Pat. No. 3,767,756.

The fibers can be spun into yarns by a number of different spinning methods, including but not limited to ring spinning, open end spinning, air jet spinning and friction spinning.

Nylon is a preferred high shrinkage fiber for this process because it shrinks readily when wetted and dried, thereby contributing to fabric dimensional stability. Other shrinkable fibers such as polyethylene terephthalate may also be used.

Determination of Fabric Shrinkage

Fabric shrinkage is determined by measuring the dimensions of the fabric before and after three wash/dry cycles. The wash/dry cycle consists of washing the fabric in a conventional home washing machine in laundry detergent at 57° C. (135° F.) with 14 minutes agitation followed by rinsing at 37° C. (100° F.) and drying in a conventional tumble dryer to a maximum dryness at a final (maximum) temperature of 71° C. (160° F.). Usually a drying time of 30 minutes is required.

EXAMPLE 1

Indigo warp dyed 3×1 twill fabric having in the warp 15 wt. % of polyhexamethylene adipamide (6,6 nylon) fibers having a linear density of 2.77 dtex (2.5 dpf) and a cut length of 3.8 cm (1.5 in), boil-off shrinkage of 6% (available as T-420 nylon fiber from E. I. du Pont de Nemours and Company, Inc.) and 65 wt. % cotton, 20 wt. % blue dyed PPD-T fibers having a linear density of 1.65 decitex (1.5 dpf) of a cut length of 3.8 cm (1.5 in), boil-off shrinkage of less than 1% and 100% open end spun cotton fill yarn. The warp has 24 ends/cm of 915 dtex ring spun yarns and the fill yarn has 16 picks/cm of 1015 dtex. The fabric was processed as follows:

a) fabric was run at about 60 meters/min. open-width through a wash box containing conventional enzyme desize aqueous solution at 60° C. to accelerate digestion of the size;

b) the fabric was accumulated and folded relaxed onto a conveyor belt in a steam chamber at 82° C. for about 3 minutes steam exposure time to induce shrinkage in the warp and fill;

c) the fabric was removed from the steam chamber at 5% lower speed than it entered the steam chamber;

d) the fabric Was then run through 5 wash boxes and rinsed with water at 80° C. to remove size;

e) the fabric was then dried over cans under tension to remove creases at 82° C. and collected by folding in a buggy;

f) the fabric which had a warp shrinkage of 11% was then compressively shrunk 11%.

The finished fabric had a warp shrinkage after laundering of −0.2% and a fill shrinkage of −2.9%. It contained no size or starch and had a uniform deep indigo color.

The fabric was cut and sewn into garments that were uniform in color and soft to the touch. Upon laundering the garment shrunk less than 3%.

I claim:

1. A method for preparing denim fabric suitable for production of garments having the uniform appearance of new garments and the soft feel of worn garments, comprising a) constructing a greige denim twill fabric with the warp yarn consisting essentially of from 20 to 90% cotton, from 10 to 80% of highly shrinkable synthetic staple fiber and optionally up to 70% of other staple fiber having low shrinkage and fill yarn consisting essentially of 20 to 100% cotton and from 0 to 80% of synthetic staple fiber, said warp and fill yarn having been sized, b) wetting the fabric with a warm aqueous solution of an enzyme to assist in size digestion, c) imparting a warp shrinkage of less than 12% by 1. maintaining the wet fabric, open width, in a relaxed condition at a temperature of from 50° C. to 100° C. for at least 0.5 minute,
2. rinsing the fabric in water to remove size, and
3. drying the fabric, open width, at sufficient tension to remove creases, and d) compressively shrinking the fabric up to 12% in the warp direction.

2. The process of claim 1 wherein the greige denim twill fabric is singled to remove fuzz.

3. The process of claim 1 wherein the highly shrinkable synthetic staple fiber of the warp yarn is 6,6 nylon.

4. The process of claim 1 wherein the warp yarns contain 20 to 90% cotton, 10 to 80% of highly shrinkable 6,6 nylon staple fiber and up to 70% of poly(p-phenylene terephthalamide) staple fiber.

5. The process of claim 3 wherein the fill yarn is cotton.

* * * * *